US006477796B1

(12) United States Patent
Cornelius

(10) Patent No.: US 6,477,796 B1
(45) Date of Patent: Nov. 12, 2002

(54) TOOTH ASSEMBLY FOR IMPLEMENTS

(75) Inventor: Erwin D. Cornelius, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/611,380

(22) Filed: Jul. 6, 2000

(51) Int. Cl.[7] ..... E02F 9/28
(52) U.S. Cl. ..... 37/452; 37/456
(58) Field of Search ..... 37/446, 452, 453, 37/454, 455, 456, 457, 458, 459, 460

(56) References Cited

U.S. PATENT DOCUMENTS

| | | | | |
|---|---|---|---|---|
| 1,925,420 | A | * | 9/1933 | Van Buskirk |
| 2,603,009 | A | * | 7/1952 | Smith |
| 3,079,710 | A | * | 3/1963 | Larsen et al. |
| 3,149,679 | A | | 9/1964 | Johnson et al. |
| 3,325,926 | A | * | 6/1967 | Wilson |
| 3,623,247 | A | * | 11/1971 | Stepe |
| 3,685,178 | A | * | 8/1972 | Ratkowski |
| 3,897,642 | A | | 8/1975 | Helton et al. |
| 3,959,901 | A | | 6/1976 | Klett |
| 4,227,744 | A | * | 10/1980 | Livesay |
| 4,231,173 | A | | 11/1980 | Davis |
| 4,360,981 | A | | 11/1982 | Bierwith et al. |
| 4,625,439 | A | * | 12/1986 | Johansson et al. |
| 4,932,145 | A | | 6/1990 | Reeves, Jr. |
| 5,386,653 | A | | 2/1995 | Cornelius |
| 5,561,925 | A | | 10/1996 | Livesay |
| 5,778,570 | A | | 7/1998 | Eichelberger |
| 5,782,019 | A | | 7/1998 | Launder et al. |

FOREIGN PATENT DOCUMENTS

| | | |
|---|---|---|
| DE | 1912098 | 9/1970 |
| GB | 1476822 | 6/1977 |
| JP | 50 147102 | 11/1975 |
| JP | 53 089203 | 8/1978 |
| JP | 10-183698 | 7/1998 |

* cited by examiner

*Primary Examiner*—Robert E. Pezzuto
*Assistant Examiner*—Kristine Markovich
(74) *Attorney, Agent, or Firm*—O G Pence

(57) ABSTRACT

A tip of a tooth assembly for a ground engaging implement or bucket is constructed with a necked down portion to provide the tip with a reduced cross-section sufficient to cause the tip to fail at the necked down portion when the tip is subjected to a sufficiently large vertical load in order to prevent the breakage of an adapter on which the tip is mounted. The tip also has side ears with side surfaces that are disposed at a slight angle relative to their mating side surfaces of the adapter ear pockets so as to diverge away from the side surface of their respective ear pocket. This construction prevents the distal ends of the ears from contacting the side surfaces when the tip experiences high side or lateral loads in order to alleviate lateral loads from being exerted on the distal ends of the ears through lateral contact with the adapter. The tip body is also constructed such that its cross-sectional area does not substantially increase between the leading cutting edge and the rearward end portion so as to maintain tip sharpness as the tip wears.

12 Claims, 4 Drawing Sheets

TOOTH ASSEMBLY FOR IMPLEMENTS

TECHNICAL FIELD

This invention relates to a tooth assembly for ground engaging implements, and more particularly to a tooth assembly having a replaceable tip mountable onto an adapter.

BACKGROUND ART

Many ground engaging implements, such as excavator buckets and the like have a plurality of teeth (or more commonly teeth assemblies) mounted across the base or cutting edge of the bucket to increase the bucket's penetration into the ground. Each tooth assembly includes a replaceable tip, which is mounted onto an adapter. The adapters are typically secured to the bucket's base edge by welding and, therefore, are not readily replaceable. The tips, on the other hand, are typically detachably mounted to the adapter in manner so as to make them easily replaceable, as such tips wear out relatively quickly. Most tips are generally wedge shaped with a sharp leading edge when new, which gives them good penetration ability. However, as the tip wears, it can become increasingly blunt, making penetration difficult and digging less efficient. Also, tips and adapters are sometimes exposed to extremely large loads during use, such as when the bucket teeth are used to penetrate rock or to pry out large stones or boulders in the ground. Such extremely large loads can overstress either the tip or adapter. The adapter, while stronger, is susceptible to breaking because the load is applied to the adapter through a longer moment arm than on the tip. Adapter breakage is less desirable that tip breakage because the adapter is more expensive and its replacement is more time consuming. As a consequence, various methods have been employed in the past to aid in the transfer of loads from the tip to the adapter. One such method is disclosed in U.S. Pat. No. 5,386,653 issued Feb. 7, 1995 to Erwin D. Cornelius and assigned to the assignee hereof, wherein the tip is equipped with a pair of opposed ears that are received into slots in the sides of the adapter. Vertical loads are transferred from the tip through the top and bottom edges of the ears, which contact the upper and lower sides of the slots. Tips, however, are exposed to high lateral loads, as well as vertical loads. Due to cocking of the tip, the distal ends of the ears may contact the side surface of the slots in the adapter, whereby such high lateral loads may overstress the ears in a lateral direction, causing them to break as well.

The present invention is directed to overcoming one or more of the problems as set forth above.

DISCLOSURE OF THE INVENTION

In one aspect of the present invention, a tooth assembly is provided for a ground engaging implement. The tooth assembly includes an adapter and a replaceable tip. The adapter is carried upon the implement and has a predetermined vertical design load capacity sufficient to withstand a predetermined large vertical load without failing. The adapter also has a forwardly extending tip mounting nose portion. The replaceable tip has an elongated body with a rearward end portion and a forward ground penetrating end portion. The rearward portion has a rearwardly opening socket cavity adapted to receive the mounting nose portion of the adapter and the forward ground penetrating end portion has a leading cutting edge at its distal end. The forward ground penetrating end portion transitions from the mounting end portion to the leading edge in a manner so as to provide a necked down portion adjacent the socket cavity of the rearward end portion. Such necked down portion has a reduced cross-section sufficient to cause the tip to fail at the necked down portion when the tip is subjected to a sufficiently large vertical load, such sufficiently large vertical load being smaller than the predetermined vertical design load capacity of the adapter so that the tip will break before the adapter.

In another aspect of the present invention, the adapter has an ear receiving pocket on each of a pair of opposite sides of the adapter. Each ear receiving pocket has a side surface therein. The rearward end portion of the tip has a pair of side ears extending rearwardly from the socket cavity, each ear being adapted for receipt within a respective one of the ear receiving pockets for transferring vertical loads from the ears into the adapter. Each ear has a distal end and an inner surface that is disposed alongside the side surface of its pocket and that extends from the socket cavity to the distal end. Each of the inner surfaces is disposed at a slight angle relative to the mating side surface of adapter ear receiving pocket so as to diverge away from the side surface of the ear pocket to alleviate lateral loads from being exerted on the distal ends of the ears through lateral contact with the adapter.

In still another aspect of the invention, the forward ground penetrating end portion of the tip transitions from the rearward end portion to the leading cutting edge wherein the tip body is constructed such that the cross-sectional area of the tip body does not substantially increase from front to rear so as to maintain tip sharpness as the tip wears.

BEST MODE FOR CARRYING OUT THE INVENTION

Figure 1:
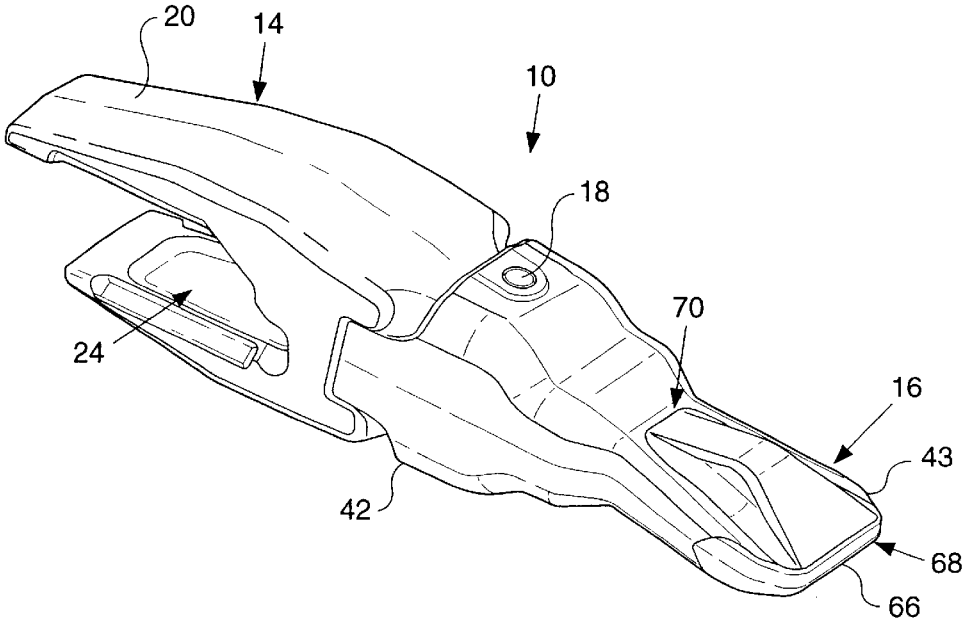
FIG. 1 a perspective view of a tooth assembly embodying the principles of the present invention.
Figure 2:
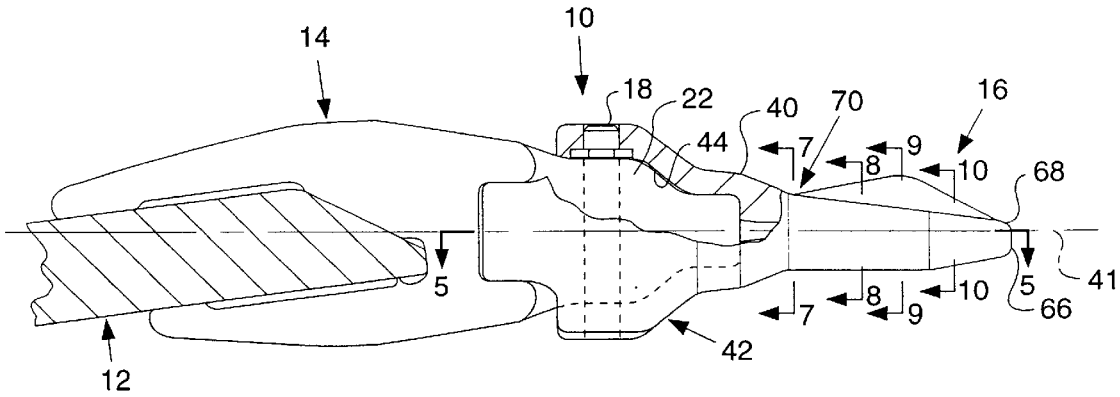
FIG. 2 is a side elevational view, with portions shown in section, of the tooth assembly depicted in FIG. 1.

Referring to the drawings, a tooth assembly embodying the principles of the present invention is generally depicted at 10 in FIG. 1. A plurality of such teeth assemblies 10 are typically employed on a ground engaging implement, such as an excavator or loader bucket (not shown) and are mounted in a spaced apart relation across a base or cutting edge, partially shown at 12 in FIG. 2, of such a bucket.

Figure 3:
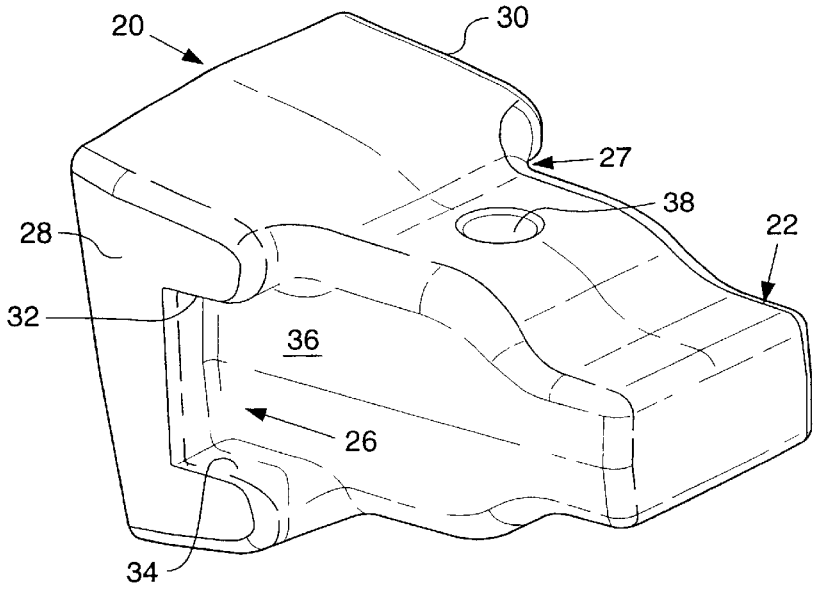
FIG. 3. is a fragmentary perspective view of the adapter of the tooth assembly depicted in FIGS. 1 and 2.

The tooth assembly 10 includes an adapter 14 and a replaceable tip 16, which is detachably secured to the adapter 14 by a pin retainer 18, or other similar retaining device known in the ground engaging tool industry. The adapter 14 has a bifurcated rearward mounting end portion 20 and a forwardly extending tip mounting nose portion 22. The bifurcated mounting end portion 20 defines a slot 24 (FIG. 1) for receiving the base edge 12 and is secured to the base edge 12 in any suitable manner, such as by welding or by mounting bolts or the like, not shown. The adapter 14 is designed so as to have a predetermined vertical design load capacity sufficient to withstand a predetermined large vertical load without failing. As best shown in FIG. 3, the adapter 14 also preferably includes a pair of ear receiving pockets 26,27, one of each pair being on a respective one of a pair of opposite sides 28,30 of the adapter 14. Each ear receiving pocket 26,27 has a pair of opposed top and bottom edge surfaces 32,34, which intersect with an inwardly recessed side surface 36. The tip mounting nose portion 22 has a generally vertically oriented retainer hole 38 extending therethrough.

Figure 4:
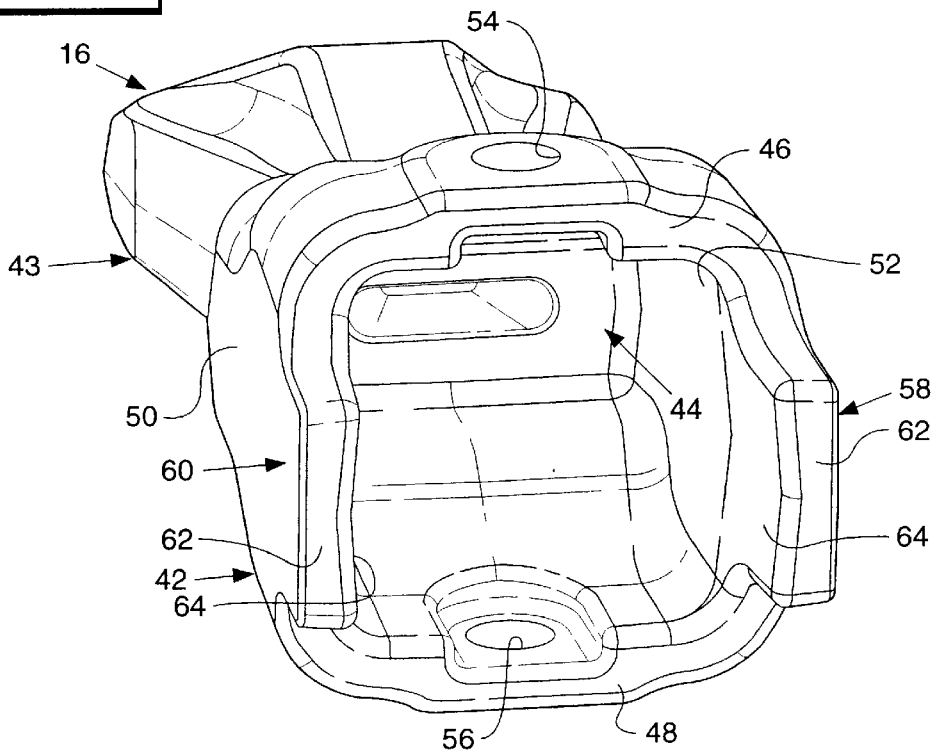
FIG. 4. is a rear perspective view of the tip of the tooth assembly depicted in FIGS. 1 and 2.

The replaceable tip 16 has an elongated body 40 disposed along a longitudinally extending axis 41 (FIG. 2) and includes a rearward end portion 42 and a forward ground penetrating end portion 43. The rearward end portion 42 has a rearwardly opening socket cavity 44 (FIG. 4) adapted to receive the mounting nose portion 22 of the adapter 14. The socket cavity 44 is formed with a top wall 46, a bottom wall 48 and a pair of opposed side walls 50,52. Each of the top and bottom walls 46,48 have one of a pair of retainer openings 54,56, respectively, therethrough. The previously mentioned retainer hole 38 of the adapter 14 is alignable with the retainer openings 54,56 in the socket cavity 44 when the nose portion 22 is received within the socket cavity 44 so as to receive the pin retainer 18 for detachable retaining the tip 16 onto the adapter 14.

Figure 6:
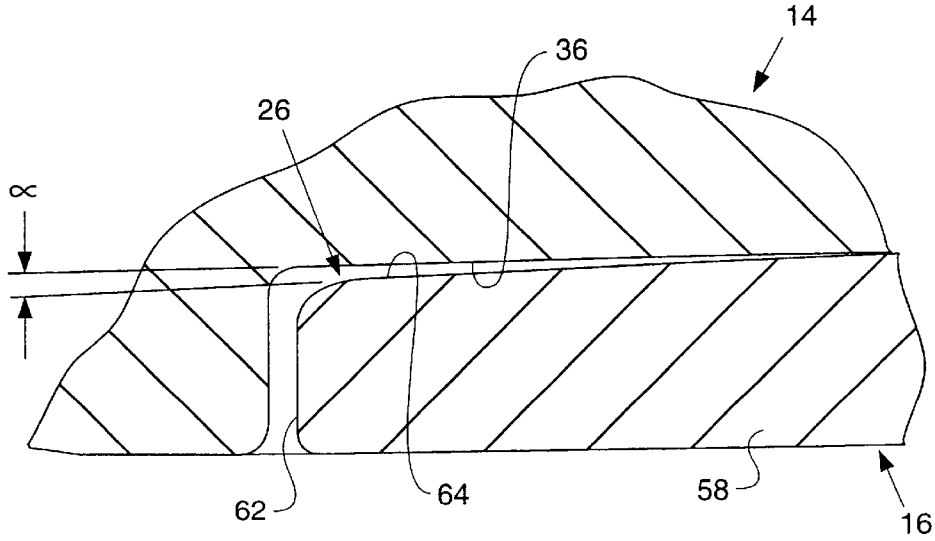
FIG. 6 is an enlarged fragmentary cross-sectional view of the ear area of area 6 in FIG. 5.
Figure 7:
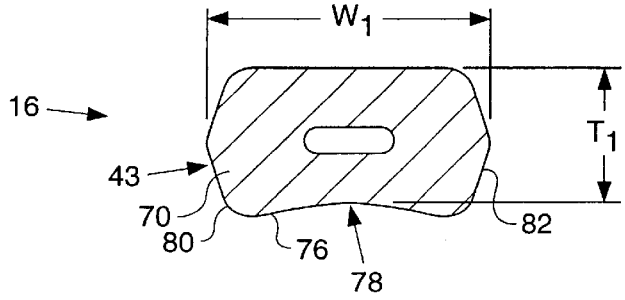
FIG. 7 is a first cross-sectional area of the tip taken along line 7—7 of FIG. 2.
Figure 8:
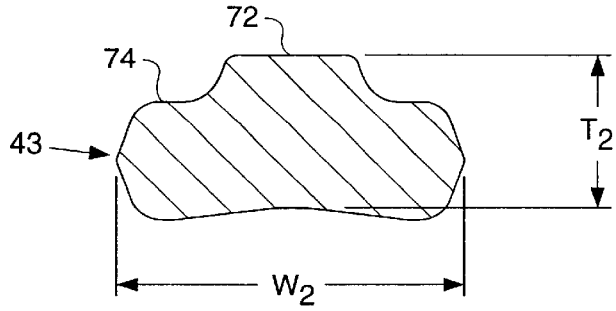
FIG. 8 is a first cross-sectional area of the tip taken along line 8—8 of FIG. 2.

The rearward end portion 42 is also provided with a pair of side ears 58,60 extending rearwardly from the socket cavity 44, each ear 58,60 being adapted for receipt within a respective one of the ear receiving pockets 26,27 for transferring vertical loads from the ears 58,60 into the adapter 14. Each ear 58,60 has a distal end 62 and an inner surface 64 disposed alongside the side surface 36 of its respective pocket 26,27. Each inner surface 64 extends from the socket cavity 44 to its distal end 62. As best shown in FIG. 6, each of the side surfaces 64 are disposed at a slight angle relative to its mating side surface 36 of adapter ear pockets 26,27 so as to diverge away from the side surface 36 of their respective ear pocket 26,27 at an angle $\alpha$ of between 1 to 5 degrees of in order to alleviate lateral loads from being exerted on the distal ends 62 of the ears 58,60 through lateral contact with the adapter 14.

The forward ground penetrating end portion 43 has a leading cutting edge 66 at its distal end 68. The forward ground penetrating end portion 43 transitions from the rearward end portion 42 to the leading edge 66 in a manner so as to provide a necked down portion 70 adjacent the socket cavity 44 of the rearward end portion 42. The necked down portion 70 is provided with a reduced cross-section sufficient to cause the tip 16 to fail at the necked down portion 70 when the tip 16 is subjected to a sufficiently large vertical load. Such sufficiently large vertical load is designed to be smaller than the predetermined vertical design load capacity of the adapter 14 so that the tip 16 will break before the adapter 14.

The tip body 40 is constructed such that the cross-sectional area of the tip body 40 does not substantially increase between the leading cutting edge and the rearward end portion so as to maintain tip sharpness as the tip wears.

Figure 5:
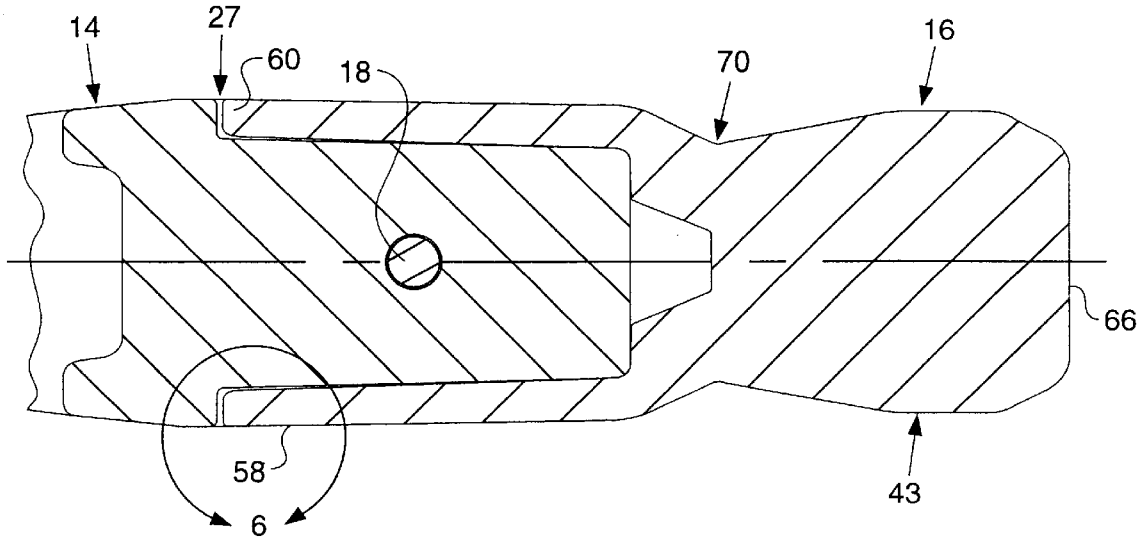
FIG. 5 is a cross-sectional view taken along line 5—5 of FIG. 2.
Figure 9:
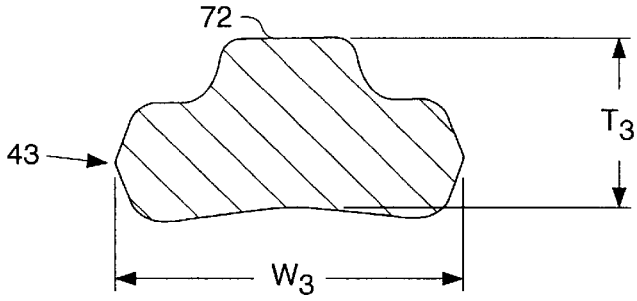
FIG. 9 is a first cross-sectional area of the tip taken along line 9—9 of FIG. 2.
Figure 10:
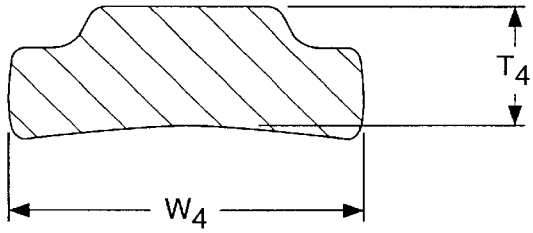
FIG. 10 is a first cross-sectional area of the tip taken along line 10—10 of FIG. 2.

In this regard, the forward ground penetrating end portion 43 is provided with a longitudinally extending, triangularly shaped central rib 72 on the upper surface 74 thereof and with a lower surface 76 with a concave V-shaped groove 78 extending longitudinally therealong. The forward ground penetrating end portion 43 also has opposite side edges 80,82 which, as viewed from the top as shown in FIG. 5, flare outwardly from the necked down portion 70 to its widest part, which is from lines 9—9 to 10—10 in FIG. 2, before narrowing again at the leading edge 66. The above features provide the forward ground penetrating end portion 43 with various cross-sectional shapes as depicted in FIGS. 7–10, wherein the width of the forward ground penetrating end portion 43 is at widest at the sections in FIGS. 9 and 10, but narrows as it progresses rearward to the necked down portion 70 shown in FIG. 7. The forward ground penetrating end portion 43 is its thinnest at the leading edge 66, but such thickness increases rapidly to its highest, as shown in FIG. 9, due to the triangularly shaped rib 72 before falling off again to a much more lower height at the necked down portion 70 in FIG. 7. As depicted in the drawings, section 7—7 has a width $W_1$ and a thickness $T_1$, while section 8—8 has a $W_2$ and thickness $T_2$, section 9—9 has a width $W_3$ and thickness $T_3$ and section 10—10 has a width $W_4$ and thickness $T_4$, wherein $W_1<W_2$; $W_2<W_3$; and $W_3=W_4$, and wherein $T_1<T_2$; $T_2<T_3$; and $T_3>T_4$. It has been found that this transitional configuration, along and in conjunction with the V-shaped bottom, greatly contribute to the tip 16 maintaining its sharpness as it wears, rather than becoming blunt as found in prior tips.

INDUSTRIAL APPLICABILITY

The construction of the present tooth assembly 10 advantageously alleviates the problems of prior teeth assemblies. In particular, the adapter 14 is designed so as to have a predetermined vertical design load capacity sufficient to withstand a predetermined large vertical load without failing. This is combined with a construction of the tip 16 with the necked down portion 70, which provides the tip with a reduced cross-section sufficient to cause the tip 16 to fail at the necked down portion 70 when the tip 16 is subjected to a sufficiently large vertical load. Such sufficiently large vertical load is designed to be smaller than the predetermined vertical design load capacity of the adapter 14 so that the tip 16 will break before the adapter 14, thus preventing breakage of the more costly adapter 14.

The side ears 58,60 of the tip 16 each have side surfaces 64 that are disposed at a slight angle relative to their mating side surfaces 36 of the adapter ear pockets 26,27 so as to diverge away from the side surface 36 of their respective ear pocket 26,27. This construction prevents the distal ends 68 of the ears 58,60 from contacting the side surfaces 64 when the tip 16 experiences high side or lateral loads in order to alleviate lateral loads from being exerted on the distal ends 62 of the ears 58,60 through lateral contact with the adapter 14. Therefore, such lateral loads on the tip 16 will not result in the bending or breakage of the side ears 58,60 and the resulting loss of their vertical load transferring ability into the adapter 14.

The tip body 40 is constructed such that the cross-sectional area of the tip body 40 does not substantially increase between the leading cutting edge and the rearward end portion so as to maintain tip sharpness as the tip wears.

Other aspects, objects and advantages of this invention can be obtained from a study of the drawings, the disclosure and the appended claims.

What is claimed is:

1. A tooth assembly for a ground engaging implement, comprising:

an adapter carried upon said implement and having predetermined vertical design load capacity sufficient to withstand a predetermined large vertical load without failing, said adapter having a forwardly extending tip mounting nose portion; and a replaceable tip having an elongated body with a rearward end portion and a forward ground penetrating end portion, said rearward portion having a rearwardly opening socket cavity adapted to receive said mounting nose portion of the adapter and said forward ground penetrating end portion having a leading cutting edge at its distal end, said forward ground penetrating end portion transitioning from said rearward end portion to said leading edge in a manner so as to provide a necked down portion adjacent said socket cavity of said rearward end portion, said necked down portion having a reduced cross-section sufficient to cause the tip to fail at said necked down portion when said tip is subjected to a sufficiently large vertical load, such sufficiently large vertical load being smaller than the predetermined vertical design load capacity of the adapter so that the tip will break before the adapter.

2. The tooth assembly of claim 1 wherein said adapter has an ear receiving pocket on each of a pair of opposite sides of said adapter, each ear receiving pocket having a side surface therein, and wherein said rearward end portion of said tip has a pair of side ears extending rearwardly from said socket cavity, each ear being adapted for receipt within a respective one of said ear receiving pockets for transferring vertical loads from the ears into the adapter and each ear having a distal end and an inner surface disposed alongside said side surface of its pocket and extending from said socket cavity to said distal end, each of said inner surfaces being disposed at a slight angle relative to the mating side surface of adapter ear receiving pocket so as to diverge away from said side surface of the ear pocket to alleviate lateral loads from being exerted on the distal ends of the ears through lateral contact with the adapter.

3. The tooth assembly of claim 1, wherein said forward ground penetrating end portion of the tip transitions from said rearward end portion to said leading cutting edge wherein said tip body is constructed such that the cross-sectional area of the tip body does not substantially increase from front to rear so as to maintain tip sharpness as the tip wears.

4. The tooth assembly of claim 1, wherein said socket cavity of the tip is formed with a top wall and a bottom wall, each of said top and bottom walls having one of a pair of retainer openings therethrough and wherein said adapter nose portion has a vertically oriented retainer hole therethrough, said retainer hole being alignable with said retainer openings in said socket cavity when said nose portion is received within said socket cavity of said tip, said tooth assembly further including a pin retainer adapted for receipt within said retainer openings of said tip and said retainer hole through said nose portion for detachable retaining said tip onto said adapter.

5. A tooth assembly for a ground engaging implement, comprising:

an adapter carried upon said implement, said adapter having a forwardly extending tip mounting nose portion and an ear receiving pocket on each of a pair of opposite sides of said adapter, each ear receiving pocket having a side surface therein; and a replaceable tip having an elongated body with a rearward end portion and a forward ground penetrating end portion, said rearward end portion having a rearwardly opening socket cavity adapted to receive said mounting nose portion of the adapter and a pair of side ears extending rearwardly from said socket cavity, each ear being adapted for receipt within a respective one of said ear receiving pockets for transferring vertical loads from the ears into the adapter and each ear having a distal end and an inner surface disposed alongside said side surface of its respective pocket and extending from said socket cavity to said distal end, each of said inner surfaces being disposed at a slight angle relative to the mating side surface of adapter ear pocket so as to diverge away from said side surface of the ear pocket to alleviate lateral loads from being exerted on the distal ends of the ears through lateral contact with the adapter.

6. The tooth assembly of claim 5 wherein said forward ground penetrating end portion of said tip has a leading cutting edge at its distal end and transitions from said rearward end portion to said leading edge wherein said tip body is constructed such that the cross-sectional area of the tip body does not substantially increase from front to rear so as to maintain tip sharpness as the tip wears.

7. The tooth assembly of claim 5, wherein said socket cavity of the tip is formed with a top wall and a bottom wall, each of said top and bottom walls having one of a pair of retainer openings therethrough and wherein said adapter nose portion has a vertically oriented retainer hole therethrough, said retainer hole being alignable with said retainer openings in said socket cavity when said nose portion is received within said socket cavity of said tip, said tooth assembly further including a pin retainer adapted for receipt within said retainer openings of said tip and said retainer hole through said nose portion for detachable retaining said tip onto said adapter.

8. A tooth assembly for a ground engaging implement, comprising:

an adapter carried upon said implement and having predetermined vertical design load capacity sufficient to withstand a predetermined large vertical load without failing, said adapter including a forwardly extending tip mounting nose portion and an ear receiving pocket on each of a pair of opposite sides of said adapter, each ear receiving pocket having a side surface therein; and a replaceable tip having a rearward end portion and a forward ground penetrating end portion, said rearward portion having a rearwardly opening socket cavity adapted to receive said mounting nose portion of the adapter and said forward ground penetrating end portion having a leading cutting edge at its distal end, said forward ground penetrating end portion transitioning from said rearward end portion to said leading edge in a manner so as to provide a necked down portion adjacent said socket cavity of said rearward end portion, said necked down portion having a reduced cross-section sufficient to cause the tip to fail at said necked down portion when said tip is subjected to a sufficiently large vertical load, such sufficiently large vertical load being smaller than the predetermined vertical design load capacity of the adapter so that the tip will break before the adapter, and said rearward end portion having a pair of side ears extending rearwardly from said socket cavity, each ear being adapted for receipt within a respective one of said ear receiving pockets for transferring vertical loads from the ears into the adapter and each ear having a distal end and an inner surface disposed alongside said side surface of its respective pocket and extending from said socket cavity to said distal end, each of said side surfaces being disposed at a slight angle relative to the mating side surface of adapter ear pocket so as to diverge away from said side surface of the ear pocket to alleviate lateral loads from being exerted on the distal ends of the ears through lateral contact with the adapter.

9. The tooth assembly of claim 8, wherein said socket cavity of the tip is formed with a top wall and a bottom wall, each of said top and bottom walls having one of a pair of retainer openings therethrough and wherein said adapter nose portion has a vertically oriented retainer hole therethrough, said retainer hole being alignable with said retainer openings in said socket cavity when said nose portion is received within said socket cavity of said tip, said tooth assembly further including a pin retainer adapted for receipt within said retainer openings of said tip and said retainer hole through said nose portion for detachable retaining said tip onto said adapter.

10. The tooth assembly of claim 9, wherein said tip body is constructed such that the cross-sectional area of the tip body does not substantially increase between said leading cutting edge and said rearward end portion so as to maintain tip sharpness as the tip wears.

11. A replaceable tip adapted for mounting on an adapter of a ground engaging implement, comprising:

an elongated body disposed along a longitudinally extending axis and having a rearward mounting end portion and a forward ground penetrating end portion, said rearward portion having a rearwardly opening socket cavity adapted to receive said adapter and a pair of side ears extending rearwardly from said socket cavity, each ear having an inner side surface, a distal end, an upper edge and a lower edge, said edges being adapted for transferring vertical loads from the ears into the adapter, and each of said inner side surfaces being disposed at a slight angle relative to said longitudinally extending axis so as to diverge away therefrom to alleviate lateral loads from being exerted on the distal ends of the ears, said forward ground penetrating end portion having a distal end and a leading cutting edge at its distal end and transitioning from said rearward end portion to said leading edge in a manner so as to provide a necked down portion adjacent said socket cavity of said rearward end portion, said necked down portion having a reduced cross-section sufficient to cause the tip to fail at said necked down portion when said tip is subjected to a sufficiently large vertical load, said elongated body being constructed such that the cross-sectional area of the elongated body does not substantially increase between said leading cutting edge and said rearward end portion so as to maintain tip sharpness as the tip wears.

12. The replaceable tip of claim 11, wherein said socket cavity of the tip is formed with a top wall and a bottom wall, each of said top and bottom walls having one of a pair of retainer opening therethrough, said retainer openings being adapted for alignment with a retainer hole in said adapter and being adapted to receive a pin retainer for detachably retaining said tip on said adapter.

* * * * *